United States Patent [19]

Heinrich et al.

[11] Patent Number: 4,526,635

[45] Date of Patent: Jul. 2, 1985

[54] PROCESS FOR MANUFACTURING HEAT EXCHANGERS FROM CERAMIC SHEETS

[75] Inventors: Juergen Heinrich, Schoenwald; Heinrich Schelter, Selb; Stefan Schindler, Selb; Axel Krauth, Selb, all of Fed. Rep. of Germany

[73] Assignee: Hoechst CeramTec Ag, Selb, Fed. Rep. of Germany

[21] Appl. No.: 415,800

[22] Filed: Sep. 8, 1982

[30] Foreign Application Priority Data

Sep. 12, 1981 [DE] Fed. Rep. of Germany ..... 3136253

[51] Int. Cl.[3] ..... C03B 29/00; C04B 33/34; C04B 37/00

[52] U.S. Cl. ..... 156/89; 156/245; 156/256; 165/1; 165/165; 165/166

[58] Field of Search ..... 156/89, 242, 245, 256; 165/1, 165, 166

[56] References Cited

U.S. PATENT DOCUMENTS

| | | | |
|---|---|---|---|
| 3,358,853 | 12/1967 | Thomas et al. | 414/80 |
| 3,940,301 | 2/1976 | Straw et al. | 156/155 |
| 3,943,994 | 3/1976 | Cleveland | 165/10 |
| 4,104,442 | 8/1978 | Sussmuth | 428/428 |
| 4,130,160 | 12/1978 | Dziedzic et al. | 165/166 |
| 4,156,051 | 5/1979 | Nakamura et al. | 156/89 |
| 4,202,660 | 5/1980 | Pei | 431/328 |
| 4,230,651 | 10/1980 | Rao | 264/29.7 |
| 4,298,059 | 11/1981 | Krauth et al. | 156/170 |

FOREIGN PATENT DOCUMENTS

| | | |
|---|---|---|
| 2544437 | 10/1975 | Fed. Rep. of Germany . |
| 2631092 | 7/1976 | Fed. Rep. of Germany . |
| 2841571 | 9/1978 | Fed. Rep. of Germany . |
| 2807755 | 3/1979 | Fed. Rep. of Germany . |
| 2165183 | 7/1973 | France . |
| 2436956 | 9/1979 | France . |
| 1418663 | 12/1975 | United Kingdom . |
| 1418459 | 12/1975 | United Kingdom . |

*Primary Examiner*—Jay H. Woo
*Assistant Examiner*—Timothy W. Heitbrink
*Attorney, Agent, or Firm*—Schwartz, Jeffery, Schwaab, Mack, Blumenthal & Koch

[57] ABSTRACT

Process and apparatus for manufacturing heat exchangers from ceramic sheets, wherein different flow channels are stamped from or pressed into the sheets, and the formed sheets are joined together with a laminating agent. The stacking of the individual sheets is effected using apparatus in which the sheets are transported to the forming means, applicator means and laminating means by horizontally and vertically displaceable, rotatable and pivotable suction plates. The organic component of the ceramic sheets is expelled from the heat exchanger block obtained in two heating steps with an intermediate forming operation to bring the heat exchanger block to its final dimensions, and the block then fired between 1,200° to 1,700° C. The actual sintering temperature depends on the particular ceramic used, which may comprise $Si_3N_4$, SiC, cordierite and/or semiconductive barium titanate compounds.

15 Claims, 6 Drawing Figures

PROCESS FOR MANUFACTURING HEAT EXCHANGERS FROM CERAMIC SHEETS

BACKGROUND OF THE INVENTION

The present invention relates to a process for manufacturing heat exchangers from ceramic sheets in which sheets are formed, stacked, laminated and dried, together with an apparatus for producing such heat exchangers from individual sheets.

German Published Application No. DE-OS 28 41 571 discloses a process for producing heat exchangers from ceramic sheets in which stamped sheets with spacers therebetween are stacked between two base plates and so-called windows are additionally machined in the covering walls. The resulting block-shaped heat exchangers are subsequently subjected to a cold or hot laminating process. The production costs of such a process are higher than the costs of producing conventional extruded ceramic heat exchangers, but very thin walls are obtained. Furthermore, the extrusion method does not permit installation of so-called baffles transversely to the direction of drawing of the flow channels. Also, handling during assembly of heat exchangers from rods and thin sheets is very difficult, and the production method is highly labor intensive. Further, it has been found during the laminating that the sheets do not all adhere uniformly to each other and particularly that the forming tools are easily clogged or fouled during the green processing of unsintered heat exchanger blocks due to the organic binder content of the sheets. If all of the binder is removed from the ceramic, the body becomes very brittle so that processing again becomes difficult.

United Kingdom Pat. No. 1,418,459 discloses a process for manufacturing heat exchangers from sheets. Sheets having a thickness of approximately 0.15 mm are produced on a combustible carrier material by a doctor blade. It has thereby been found to be especially disadvantageous that the spacers between the separating walls for the heat exchange media are made by a very expensive technique poorly suited for mass production. The heat exchanger is constructed by alternately stacking silicon synthetic resin sheets and spacers attached to cast sheets. Using pressure and heat as well as a solvent or an adhesive, the individual parts of the heat exchanger are assembled. During firing, first the paper must be removed, then the binder and finally, the nitriding process is effected. During combustion of the paper, care must be taken not to damage the fine silicon structure. The ash formed in the process is removed by ultrasonic cleaning. Furthermore, prior to burning the paper, partial nitriding of the heat exchanger block must be effected.

The shortcomings found in the described processes do not permit rational mass production. Additionally, the completed heat exchangers often exhibit non-homogeneous structures. In particular, it has been found that the flow behavior of heat exchangers made of silicon nitride is not optimal, since as a result of the porous surface of silicon nitride, smooth flow channels are not obtained.

SUMMARY OF THE INVENTION

Accordingly, it is an object of the present invention to provide an improved process for producing heat exchangers from ceramic sheets.

Another object of the present invention is to provide a process for manufacturing heat exchangers from ceramic sheets in which the sheets are substantially uniformly bonded to each other to produce dimensionally accurate, homogeneous structures.

A further object of the present invention is to provide a process for manufacturing heat exchangers from ceramic sheets capable of producing defect-free, thin wall structures without encountering severe handling restrictions or difficulties during manufacture.

It is also an object of the present invention to provide a process for manufacturing heat exchangers from ceramic sheets capable of readily producing transverse baffles in the flow channels of the heat exchanger.

An additional object of the present invention is to provide a process for manufacturing heat exchangers from ceramic sheets in which the material from which the heat exchanger is formed can be readily worked or formed without a pronounced tendency to foul the forming tools.

Yet another object of the present invention is to provide a process for manufacturing heat exchangers from ceramic sheets which is especially suited for mass production by automated manufacturing techniques.

A still further object of the present invention is to provide a process for manufacturing heat exchangers from ceramic sheets at comparatively low cost.

Additionally, it is also an object of the invention to provide improved apparatus for manufacturing heat exchangers from ceramic sheets according to the process of the invention.

These and other objects of the invention are achieved by providing a process for manufacturing heat exchangers from ceramic sheets comprising the steps of producing ceramic sheets from a ceramic slip; subjecting at least some of the sheets to a forming operation to form desired flow channels therein; applying a laminating aid to the sheets; stacking the individual sheets in a desired order to form a heat exchanger block; laminating the stacked sheets together; heating the laminated heat exchanger block to reduce the organic content to from 40 to 60 percent of the initial organic content; subjecting the once heat treated heat exchanger block to a forming operation; thereafter subjecting the heat exchanger block to a heat treatment at a temperature from 200° to 300° C. to remove the remaining organic content; and sintering the laminated heat exchanger block at a temperature from 1,200° to 1,700° C.

In a further preferred aspect of the invention, a plurality of individual sheets are prelaminated to form a thicker sheet assembly, or card, prior to formation of a desired pattern of flow channels therein whereby flow channels having a height greater than the thickness of an individual sheet can be formed.

In yet another preferred aspect of the invention, the inlet and outlet openings of the sintered heat exchanger block are subjected to an optional additional forming operation.

In still another preferred aspect of the present invention, apparatus is provided for manufacturing heat exchangers from ceramic sheets comprising: magazine means for storing ceramic sheets; at least one means for forming flow channels in ceramic sheets; means for applying a laminating aid to said ceramic sheets; means for laminating said sheets; and horizontally and vertically displaceable, pivotable and rotatable suction plate means for transporting ceramic sheets as desired between said magazine means, forming means, applying means and laminating means.

BRIEF DESCRIPTION OF THE DRAWINGS

The invention will be described in further detail hereinafter with reference to the accompanying drawings, wherein.

Figure 3:
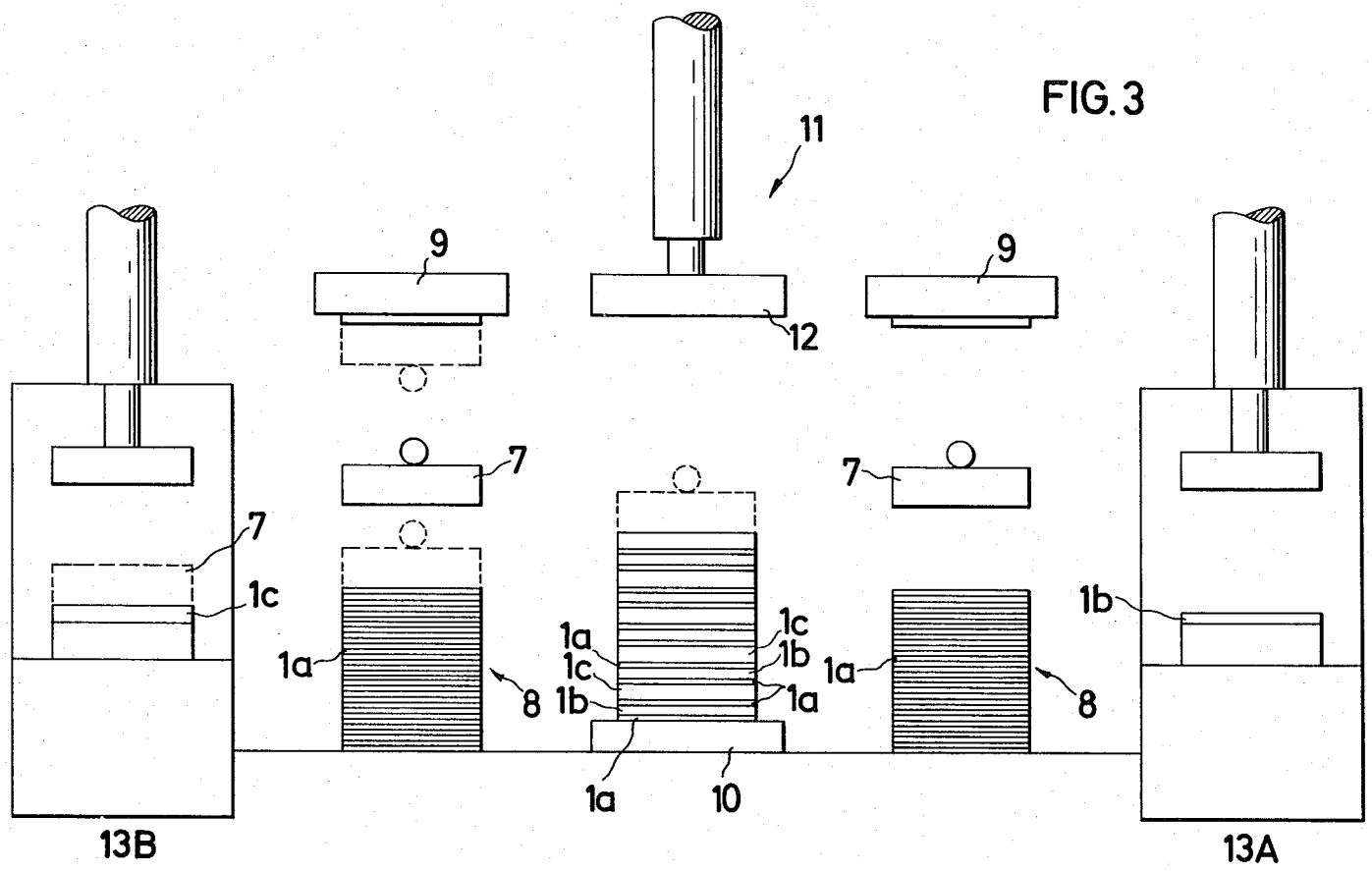
Figure 4:
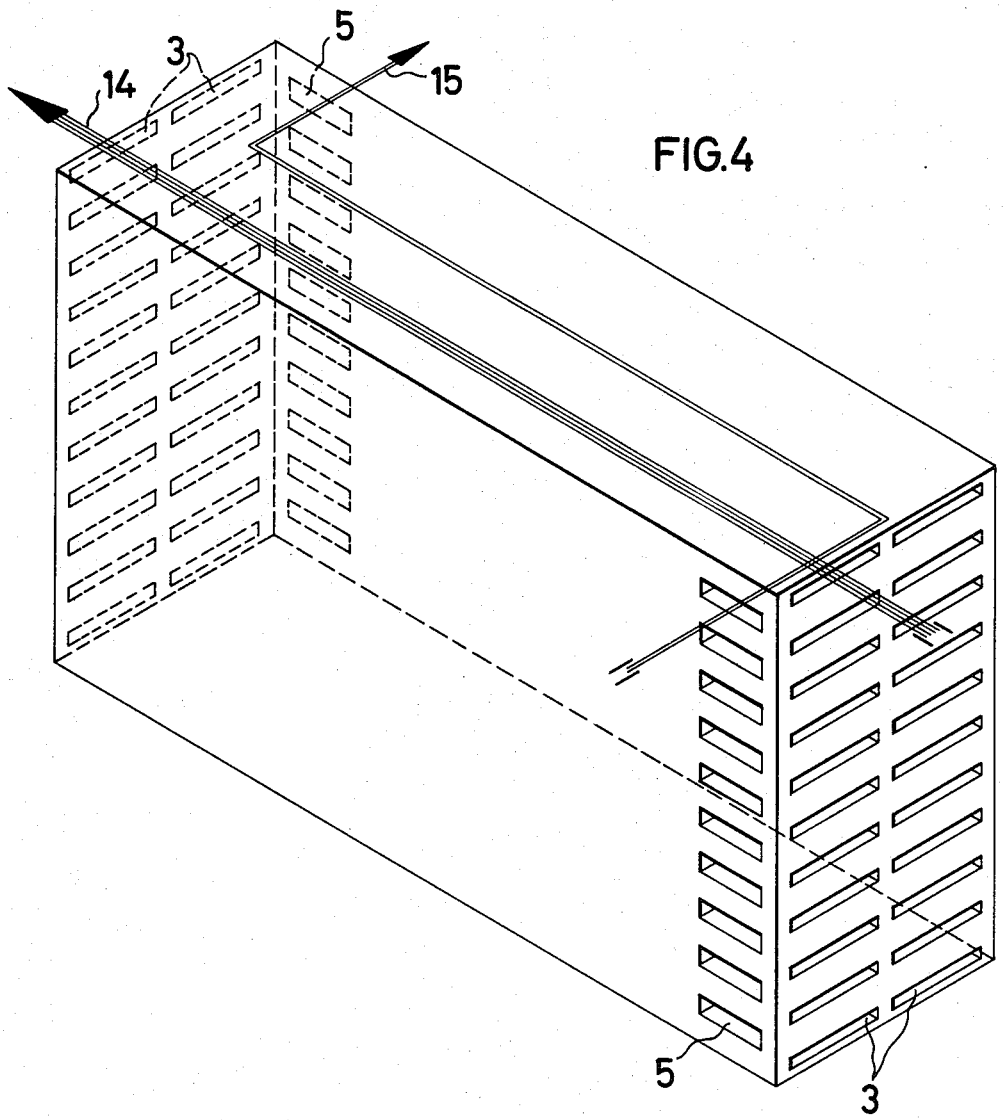

FIGS. *2a*, *2b* and *2c* show plan views of three sheet assemblies; FIG. *2a* shows a sheet without channels; FIG. *2b* shows a sheet with flue gas channels, and FIG. *2c* shows a sheet with water pockets;

FIG. 3 is a schematic representation of an apparatus for assembling a heat exchanger block from individual sheets; and FIG. 4 is a perspective view of a heat exchanger embodiment manufactured according to the process of the invention.

DETAILED DESCRIPTION OF PREFERRED EMBODIMENTS

Conventional ceramic slips may be used to produce the ceramic sheets used in the present invention. The slips typically comprise a ceramic powder, organic binders, dispersants or thinners and optionally plasticizers, as well as other additives in the form of oils. It is usual to start with mostly silicon slips, to which preferably 3 to 10 weight percent cordierite are added. Other ceramic powders comprise cordierite having a composition of from 9 to 20 weight percent MgO, from 30 to 50 weight percent $Al_2O_3$ and from 41 to 57 weight percent $SiO_2$. Silicon carbide is also well suited, whereby the mixture may comprise from 70 to 92 weight percent SiC and 8 to 30 weight percent C. Semiconductive barium titanates may also be used if the heat exchanger block is to be used simultaneously as a heating element by applying an electric current thereto.

The organic binder is not subject to any special restrictions so long as good bonding to the ceramic powder is assured and the sheets, optionally containing a plasticizer, possess the necessary ductility and dimensional stability. Polyvinylacetate and polyvinylbutyral have proved especially suitable.

Water or organic solvents, such as for example ethanol, toluene and trichloroethylene, may be used as dispersants and thinners.

Particularly suitable formulas for producing ceramic sheets according to the invention are set forth in the following table wherein the slip formula is broken down into ceramic raw material, binder and solvent.

| Raw Materials | Preferred Range (% by weight) | Specific example (% by weight) |
|---|---|---|
| Ceramic Powder | 60–70 | 65 |
| Binder | 7–10 | 8 |
| Solvent | 23–30 | 27 |

The viscosity of the slip is particularly affected by the solvent content. It has also been found that the application of ultrasonic energy in the preparation of the casting slip is especially advantageous. Through such treatments, a casting slip of greater homogeneity, improved casting properties and a maximum solids content is obtained which particularly affects the green density of the sheet. In this manner, sheets with a higher packing density and improved mechanical properties may be obtained. It is further advantageous to provide a vibrating device on the casting belt, whereby the casting slip is further densified and a uniform sheet thickness over the entire width of the belt is made possible.

According to the process of the invention, the ceramic sheets are brought to their final dimensions after lamination. If thick sheets and very high flow channels are required, which exceed the individual sheet thickness of 0.1 to 1.5 mm, the sheets may be combined in a prelaminating process using a laminating aid into sheet assemblies or cards. The various flow channels are then stamped from these sheets or sheet assemblies, or the sheets are subjected to a press forming operation. In the latter case, the ceramic sheets are subjected to pressures from 5 to 100 bar in appropriate molds or dies at temperatures from 20° to 120° C. whereby comb-like projections are formed.

The stamped or press-formed sheets or sheet assemblies are then stacked in a desired order by means of the apparatus of the invention to form a heat exchanger block, in which lamination of the individual layers is simultaneously effected with the aid of a laminating press.

In the laminating process, a press installation is used at a pressure from 0.1 to 15 bar, preferably 1 bar, for a time interval from 1 to 15 seconds. The process is normally conducted at ambient temperatures, but temperatures up to 100° C. may be used. In individual cases, the pressure which is used depends on the content of organic binder and the nature of the laminating aid. For the laminating process, one may use either a paste, which preferably contains a ceramic filler, or a pure organic adhesive applied by means of screen printing, spraying or rollers. The use of a laminating aid affords a number of advantages. First, use of low pressures during the laminating process is facilitated, whereby deformation of the flow channels is avoided. Further, undulations in the sheets are equalized. Finally, the laminating aid meaningfully reduces laminating defects.

Subsequently, the organic components are removed by heating to from 40 to 60 percent of the synthetic resin component, which produces additional raw or green strength. This also results in the heat exchanger block being readily workable or formable without the forming tools becoming fouled by the organic components of the ceramic sheet, e.g. during removal of the marginal portions 2 of the sheets.

Thereafter, the remaining organic components are removed by heating and the heat exchanger block is sintered at a temperature between 1,200° and 1,700° C. Additional working or forming of the inlet and outlet openings of the flow channels may be needed in order to obtain good connections to the various heat exchange media which are to be conveyed to or away from the heat exchanger.

The invention further relates to an apparatus for carrying out the process of the invention. The apparatus of the invention comprises a combined forming means, laminating aid applicator, and laminating device. The sheets or prelaminated sheet assemblies are subjected to a forming process to shape the flow channels. The formed sheets are then transported by means of suction plates which are horizontally and vertically movable and pivotable through 180° to the applicator for the laminating aid. From the laminating aid applicator, the suction plate pivots to the laminating press and alternately deposits the different shaped sheets or sheet assemblies in a desired order to assemble the heat exchanger block. The resulting stacks are then pressed in the laminating press.

The process of the invention, particularly in conjunction with the apparatus of the invention, facilitates a high degree of automation since no continuous working sequence has been possible in prior production processes because of the individual handling required during stamping, positioning and laminating. By following the process of the invention, heat exchangers are also obtained which are very homogeneous and which exhibit very good contact between the individual sheets after sintering. The process of the invention further yields better quality heat exchangers, and so-called baffles or deflectors may be built into the flow channels transverse to the direction of flow without major effort or expense. The presence or absence of baffles as well as the number, spacing and orientation thereof may be freely selected and are no longer dependent on the manufacturing process. A further possibility envisions producing curved flow channels. Thus, unsymmetrical or cylindrical heat exchangers can be produced. It is further possible to produce heat exchangers which selectively comprise layers of silicon nitride, silicon carbide and cordierite in the form of plates or sheets, according to Published German Application No. DE-OS 26 31 092. The use of cordierite, particularly with silicon nitride, results in smooth flow channels which, consequently, have a low resistance to flow.

Figure 1:
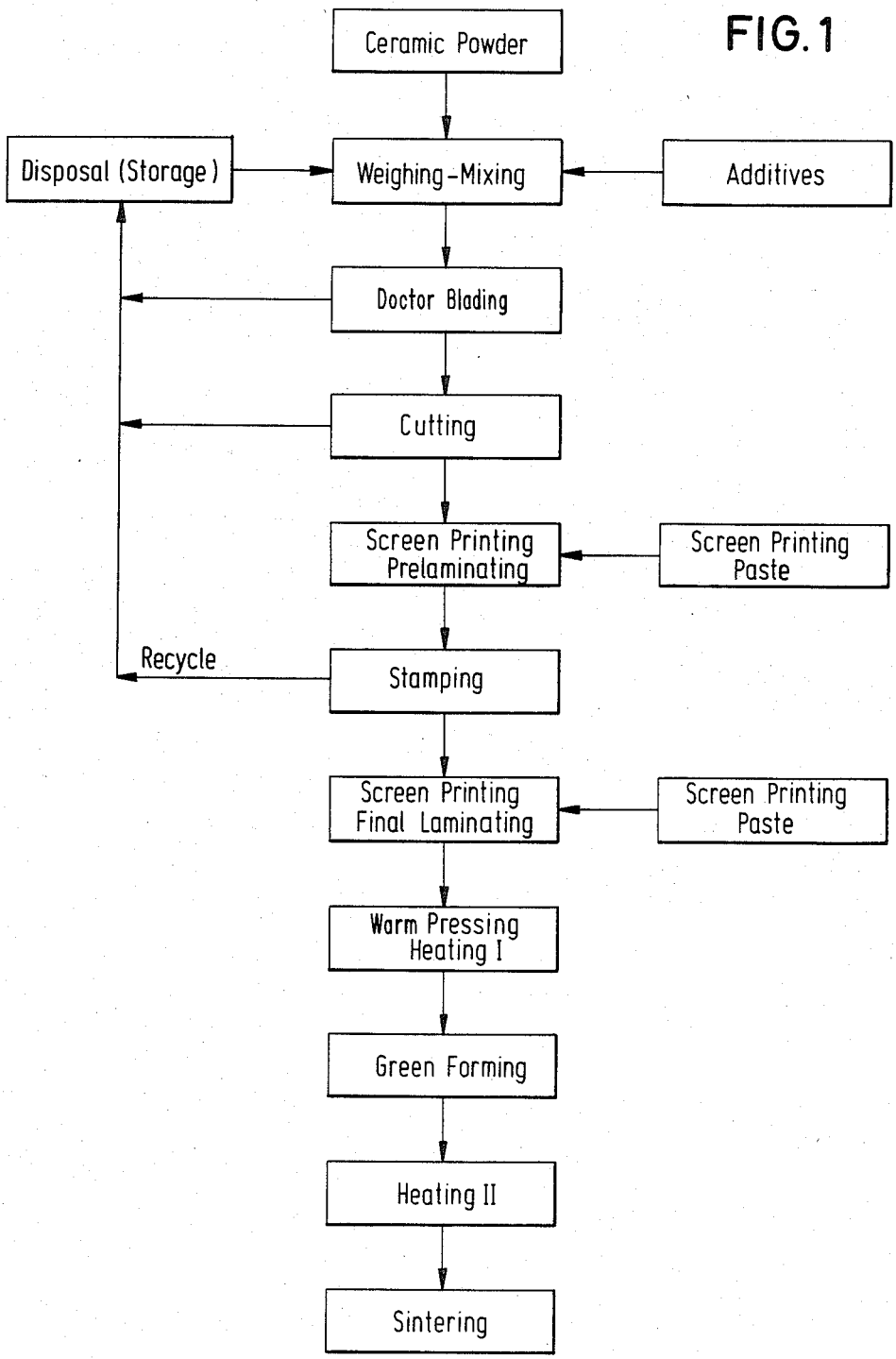
FIG. 1 is a schematic flow chart for the process of the invention.

Turning now to the drawings, FIG. 1 shows a flow chart for the process of manufacturing a gas/liquid heat exchanger of silicon nitride. To prepare the ceramic slip, 100 parts by weight silicon powder are mixed with 24 parts by weight ethanol, 10 parts by weight toluene, and 1.5 parts by weight menhaden oil, 8 parts by weight polyvinylbutyral and as the plasticizer, 5 parts by weight palatinol and/or ucon oil. This mixture is milled for 20 hours in a tumbling mill with $Al_2O_3$ balls, and the slip is then removed. The usual casting of the slip to produce sheets is effected on a steel belt. The slip may be applied to the casting belt by means of a casting shoe, with the sheet thickness being determined by the adjustable gap height of from 0.2 to 1.5 mm of the doctor blade equipment. A continuous sheet is then removed from the steel belt and severed to produce individual sheets. It has been found to be advantageous to construct so-called prelaminates of two to three sheets. The joining of the individual sheets to each other is achieved by spraying or applying a laminating aid thereon. In the latter case, a paste is used, comprising for example 50 to 77 weight percent, e.g. 65 weight percent, silicon and/or cordierite or a mixture thereof. The paste further comprises 20 to 40 weight percent unsaturated alcohols and 3 to 10 weight percent binders which comprise plasticizers and polyvinylbutyral. The paste is applied in this case by a screen printing process. The solids content of the paste simultaneously equalizes any unevenness of the sheet surface. Similarly, a surface dissolution of the sheets by the paste takes place, which later leads to homogeneous joining of the individual sheets. When silicon sheets are used, it is appropriate to cover the prelaminate completely with the paste, especially when the paste contains a cordierite component which, with the silicon nitride formed later, leads to sweating out of a glass phase, resulting in smooth and dense flow channels. Otherwise, only those areas are printed which are necessary for joining the sheets. In this manner, parts stamped out of the sheets may be recycled and added to the casting slip.

Figure 2B:
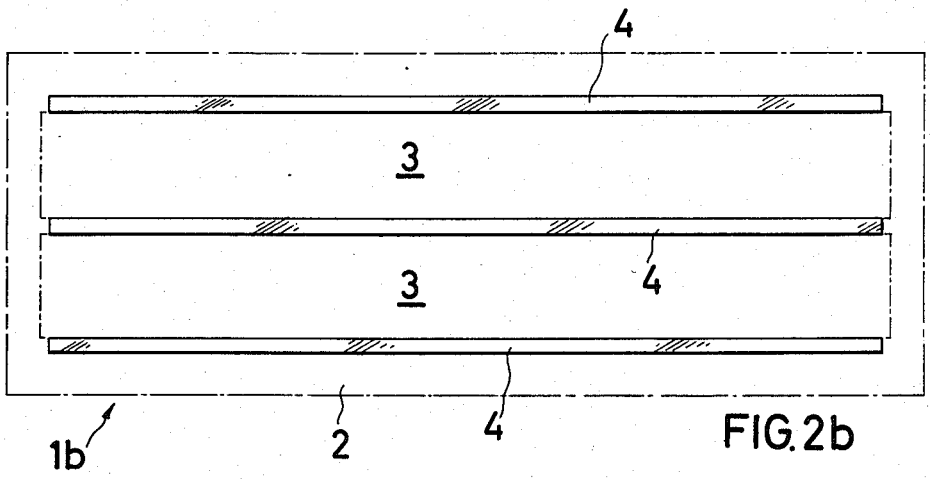
Figure 2A:
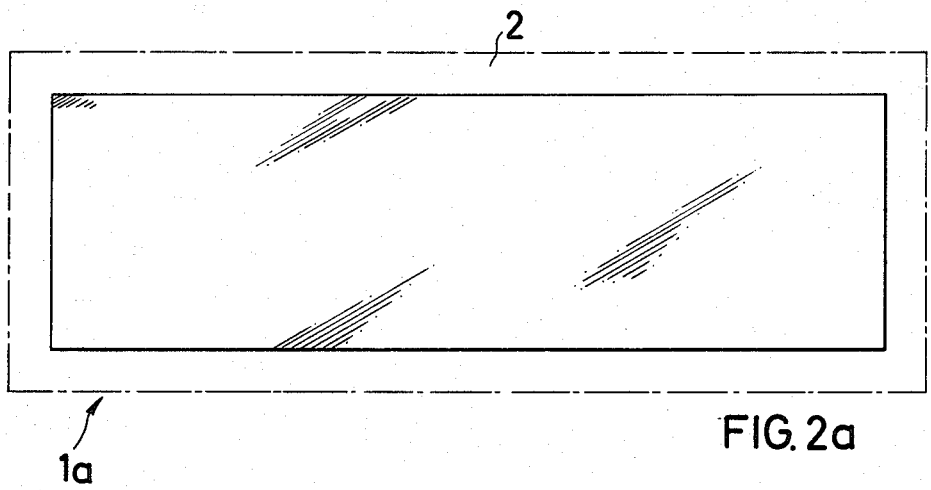
Figure 2C:
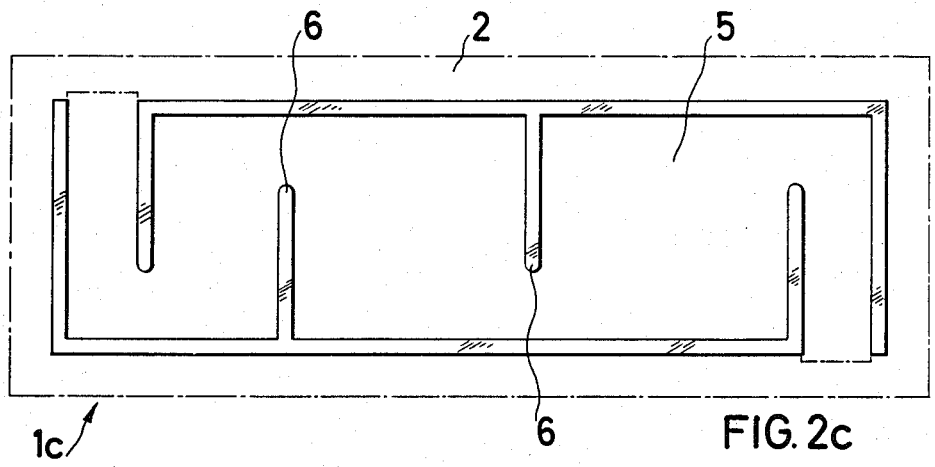

FIGS. 2*a*, 2*b* and 2*c* show rectangular sheet members for constructing a gas heater heat exchanger. The individual sheets have a thickness of 0.9 mm. As noted above, thicker members are formed from a plurality of individual sheets by prelaminating them together to produce prelaminated sheet assemblies. The sheet assemblies have dimensions of 120 mm×400 mm and are provided with an additional margin 2 which is removed during subsequent working. In the stamped assembly 1*b* having a thickness of 1.8 mm, the flue gas channels 3 are 50 mm wide and the walls 4 have a width of 3 to 7 mm. The stamped out water pockets 5 of assembly 1*c* have a width of 100 mm and are provided with baffles or deflectors 6 perpendicular to the direction of flow, and the thickness of this sheet assembly amounts to 2.7 mm. The baffles serve particularly to assure that the temperature distribution in the flow channels is uniform.

The heat exchanger block is assembled using the apparatus of the invention as seen in FIG. 3. The suction plate 7 takes sheets 1*a*, which also serve as covers between the subsequent, stamped assemblies 1*b* and 1*c*, from a stack in storage magazine 8. Suction plate 7 then pivots 180° and moves the sheet 1*a* under the screen printing device 9. Here, the laminating aid is applied. The suction plate 7 then places the sheet onto the bottom 10 of the laminating press 11 and returns to the storage magazine 8. A new sheet 1*a* is then transported to a stamping press 13A, 13B. By transporting several sheets from the magazine to the screen printing device and then to the stamping press, a thicker sheet assembly can be built up so that higher flow channels can be formed. Advantageously, a stamping press 13A is provided for the flue gas channels 3 and a stamping press 13B for the water pockets 5. The suction plate 7 now picks up the stamped assembly 1*b* or 1*c* and moves it under the screen printing device 9 for application of the laminating aid. After completion of the screen printing process, the suction plate 7 is pivoted 180°, and the assembly 1*b* or 1*c* is applied under a slight pressure onto a sheet 1*a*. The heat exchanger block is stacked up by alternate deposition of the sheets 1*a* onto the stamped assemblies 1*b* and 1*c*. The completed heat exchanger block is then pressed in the laminating press 11 between the top part 12 and the bottom part 10, whereby the laminating process is simultaneously begun.

After removal from the laminating press, the stacked heat exchanger block is subjected to heat treatment at temperatures from 100° to 200° C. The organic components, particularly the plasticizer and the laminating aid, are volatilized thereby. This heat treatment lasts for one to two days, whereby 40 to 60 percent of the organic components are driven from the heat exchanger block. Thereafter, the heat exchanger block may be worked or formed by milling or sawing so that it attains its final dimensions. Over a period of approximately 2 to 3 days, the remaining organic content is removed by heating at temperatures between 200 ° and 300° C. This measure eliminates, particularly in the case of silicon sheets, the conventional pre-sintering or pre-nitriding at 1,100 ° to 1,300° C. Nitriding is then effected in the known manner between 1,300° and 1,400° C. As mentioned hereinabove, the density of the finished silicon heat exchanger may be increased by desirably replacing 3 to 10 percent by weight silicon by cordierite in the laminating aid. This measure may also be taken with the casting slip. Then, however, a post-sintering at temperatures between 1,300° and 1,400° C. is required, in the presence of oxygen, as seen in German Pat. No. DE-P 25 44 437.

The result of the process is a homogeneous, one-piece heat exchanger having a uniform mechanical strength.

FIG. 4 shows an assembled heat exchanger from which the margins 2 have been removed. The direction of the flue gas flow is indicated by arrow 14, and the direction of the water flow is indicated by arrow 15.

The foregoing description has been set forth merely to illustrate the invention and is not intended to be limiting. Since modifications of the described embodiments incorporating the spirit and substance of the invention may occur to persons skilled in the art, the scope of the invention is to be limited solely with respect to the appended claims and equivalents.

We claim:

1. A process for manufacturing heat exchangers from ceramic sheets comprising the steps of:

producing ceramic sheets from a ceramic slip;

subjecting at least some of the sheets to a first forming operation to form desired flow channels therein;

applying a laminating aid to the sheets;

stacking the individual sheets in a desired order to form a heat exchanger block;

laminating the stacked sheets together;

heating the laminated heat exchanger block to reduce the organic content of the block to 40 to 60 percent of the initial organic content;

subjecting the once heat treated heat exchanger block to a second forming operation to form the assembled block to a desired configuration;

thereafter subjecting the heat exchanger block to a heat treatment at a temperature from 200° to 300° C. to remove the remaining organic content; and sintering the laminated heat exchanger block at a temperature from 1,200° to 1,700° C.

2. A process according to claim 1, wherein a plurality of individual sheets are prelaminated to form a sheet assembly having a desired increased thickness prior to formation of the flow channels, whereby flow channels having a greater height can be formed therein.

3. A process according to claim 1, wherein the lamination of all the individual layers takes place at the same time.

4. A process according to claim 1, wherein the flow channels are formed by stamping out portions of the sheets.

5. A process according to claim 1, wherein the flow channels are formed by press-forming the sheets.

6. A process according to claim 1, wherein inlet and outlet openings are formed in the heat exchanger block, further comprising the step of subjecting the inlet and outlet openings of the sintered heat exchanger block to an additional forming operation to facilitate making connections to said inlet and outlet openings.

7. A process according to claim 1, wherein said ceramic slip is a silicon slip.

8. A process according to claim 7, wherein said silicon slip comprises from 3 to 10 weight percent cordierite.

9. A process according to claim 1, wherein said ceramic slip is a cordierite slip comprising from 9 to 10 weight percent MgO, from 30 to 50 weight percent $Al_2O_3$ and from 41 to 57 weight percent $SiO_2$.

10. A process according to claim 1, wherein said ceramic slip is a silicon carbide slip comprising from 70 to 92 weight percent SiC and from 8 to 30 weight percent C.

11. A process according to claim 1, wherein said ceramic slip comprises semiconductive barium titanate compounds.

12. A process according to claim 1 further comprising the step of subjecting the casting slip to ultrasonic energy prior to formation of the ceramic sheets.

13. A process according to claim 1, wherein said ceramic sheets are cast on a casting belt, and said casting belt is provided with a vibrating device.

14. A process according to claim 1, wherein baffles are produced in the flow channels during the flow channel forming operation.

15. A process according to claim 1, wherein said flow channels are formed by a press-forming operation in which the ceramic sheets are subjected to a pressure of from 5 to 100 bar in a die at a temperature of from 20° to 120° C.

* * * * *